US006989498B1

(12) United States Patent
Linder et al.

(10) Patent No.: US 6,989,498 B1
(45) Date of Patent: Jan. 24, 2006

(54) METHOD AND DEVICE FOR LOCKING

(75) Inventors: Hans Linder, Ludvika (SE); Ulf Borg, Nyhammar (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 10/070,720

(22) PCT Filed: Sep. 8, 2000

(86) PCT No.: PCT/SE00/01754

§ 371 (c)(1),
(2), (4) Date: May 31, 2002

(87) PCT Pub. No.: WO01/20627

PCT Pub. Date: Mar. 22, 2001

(30) Foreign Application Priority Data

Sep. 10, 1999 (SE) ..... 9903246

(51) Int. Cl.
*H01R 9/28* (2006.01)

(52) U.S. Cl. ..... 200/43.14
(58) Field of Classification Search ..... 200/43.14
See application file for complete search history.

(56) References Cited

U.S. PATENT DOCUMENTS

| | | | | |
|---|---|---|---|---|
| 4,210,788 A | * | 7/1980 | Stranczek | 200/43.14 |
| 5,196,658 A | | 3/1993 | Gula | |
| 5,477,016 A | | 12/1995 | Baginski et al. | |
| 5,584,378 A | * | 12/1996 | Wecke et al. | 200/43.11 |
| 5,700,985 A | | 12/1997 | Fischer et al. | |
| 5,817,998 A | * | 10/1998 | Siebels et al. | 200/43.14 |

FOREIGN PATENT DOCUMENTS

DE 30 25 174 A1 1/1982

* cited by examiner

*Primary Examiner*—Renee Luebke
(74) *Attorney, Agent, or Firm*—Buchanan Ingersoll PC

(57) ABSTRACT

The present invention concerns a method and a device for locking a disconnecting breaker. During locking of a single-poled or multiple-poled disconnecting breaker, the actuator of the breaker is first locked both electrically and mechanically. When the breaker is in the open position, the distance between the contacts of the breaker comprises the conductor spacing for the isolation function. The electrical and mechanical locking of the actuator is indicated both electrically and mechanically. Subsequently, the link system of the breaker is mechanically locked. The link system is locked in the interlocked position. Locking of the link system is indicated by at least one indicator. Locking of the actuator of the breaker can be controlled manually via a key- and lock device, or remotely.

40 Claims, 6 Drawing Sheets

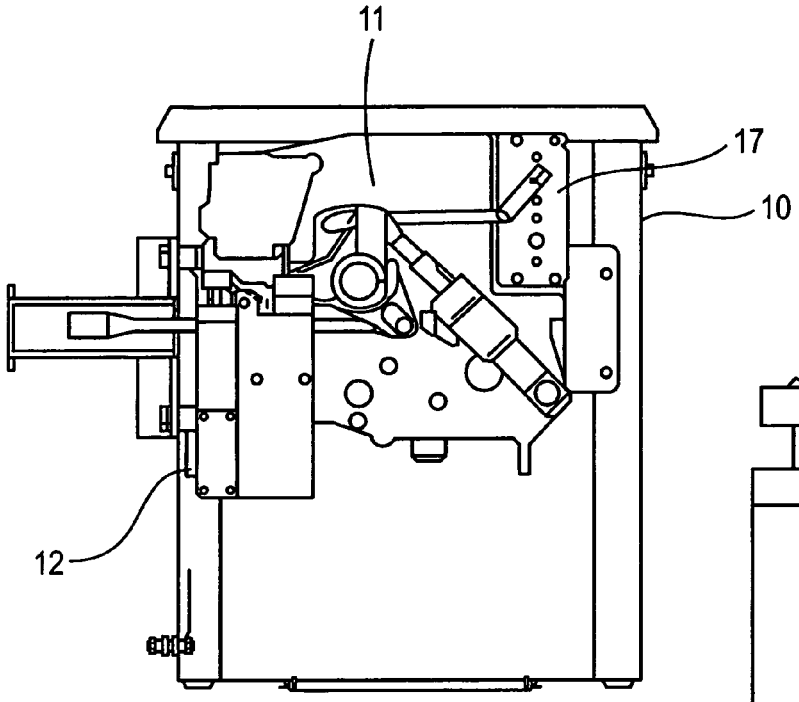
FIG. 3A
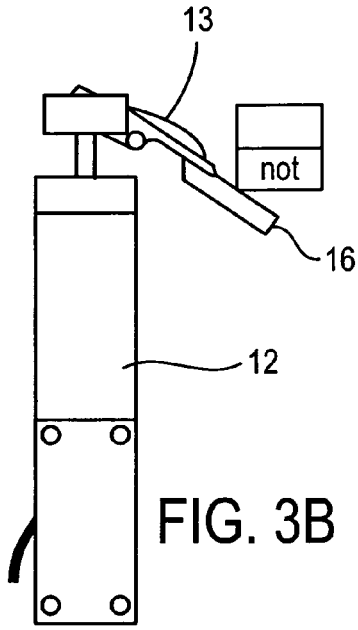
FIG. 3B
FIG. 3C
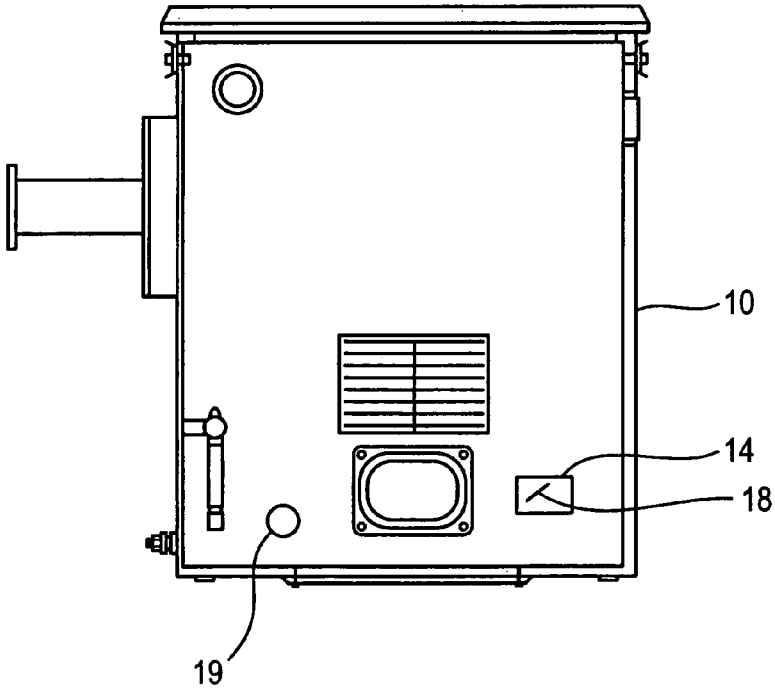

METHOD AND DEVICE FOR LOCKING

The present invention concerns a method and a device for locking a circuit breaker and a grounding switch in order to be used as a disconnecting breaker.

THE PRIOR ART

Switching of power lines, cables, power transformers, etc. is done by circuit breakers. Safety regulations have earlier required a disconnector with a visually open conductor spacing during work on, for example, a high voltage switch gear. According to the traditional solution, a breaker and a disconnector have together ensured that the section of the equipment where the work is to be carried out is disconnected. This type of solution requires at least one, and often two, disconnectors with demanding maintenance in order to ensure their correct function. Each disconnecting breaker must be correctly installed with a foundation that requires space and expensive installation time. The present invention is intended to solve the problems described above. The intention is to provide a compact solution, reliable from the point of view of safety, that is simple to manufacture and cost-effective for the customer. The construction permits manufacture of the parts according to known technology.

SUMMARY OF THE INVENTION

The present invention concerns a method and a device for locking a circuit breaker and a grounding switch to be used as a disconnecting breaker. The earlier requirement for a visually open disconnector has been replaced according to new regulations by the requirement for a reliable indication that a section of the equipment is disconnected. The disconnecting breaker replaces a circuit breaker, one or two series connected disconnectors, and means for grounding. The disconnecting breaker can be either of single-pole type or multiple-pole type depending on its operating voltage.

During locking of a single-or multiple-poled disconnecting breaker that includes a linkage system, known as a "rod system", for closing and opening operation of the contacts of the breaker, the actuator of the breaker is first locked electrically and/or mechanically, after which the linkage system may also be solidly locked by a mechanical device. When the breaker is in the open position, the distance between the contacts of the breaker constitutes the conductor spacing of the disconnecting function, and is large enough to provide the electrical insulation required for the disconnecting function. The electrical and mechanical locking of the actuator is indicated both electrically and by suitable indicators (lamp, arrow, etc.). Following the safe locking of the breaker in the open position, the grounding switch can be operated to safely ground one of the breaker terminals.

The locking of the actuator of the breaker is achieved with the aid of an electromagnetic blocking unit that can be operated with a hand-operated key-and lock device. The blocking unit can in one preferred embodiment be operated by remote control, e.g. by interrupting the control power to the actuator. In one preferred embodiment, operation of a hand-operated key- and lock device controls an electromagnet that locks a blocking package of the actuator of the breaker by both breaking the operating current to the actuator and by mechanically blocking the actuator. The key device is freed from the lock device following the locking of the actuator of the breaker and is used in a second lock device for mechanical locking of the rod system with the aid of a blocking unit. The rod system is locked in the open breaker position with a second key device and a third lock device. The blocking of the rod system is indicated by at least one indicator.

According to one embodiment of the device, the second key device is used with a fourth lock device in order to free a blocking unit, which makes it possible to move a grounding switch, also known as an earth knife or other earth device. Once the earth knife has been connected to one of the breaker contacts, the earth knife is blocked in its connected position and locked with the second key device and the fourth lock device.

The electrical and mechanical locking of the actuator of the breaker can in one preferred embodiment be achieved with a remote-controlled locking device. The remote-controlled locking of the actuator of the breaker is indicated by electrical and mechanical indicators on the breaker and by indicators on the remote-control unit. In an exemplary embodiment the remote-controlled locking device includes the operation of a blocking device for the earth knife, during which operation, movement of the earth knife causes blocking of the rod system. The system according to the invention is very reliable from the point of view of safety due to the locking in one preferred embodiment being performed by the exchange of keys, and due to electrical and mechanical indicators showing in multiple ways that the breaker is safely locked to prevent any operation.

BRIEF DESCRIPTION OF THE FIGURES

FIGS. 3A–3C show an actuator (a), including an electromagnet (b) and an external surface (c) for operation of a breaker.

DETAILED DESCRIPTION OF PREFERRED EMBODIMENTS

Figure 1:
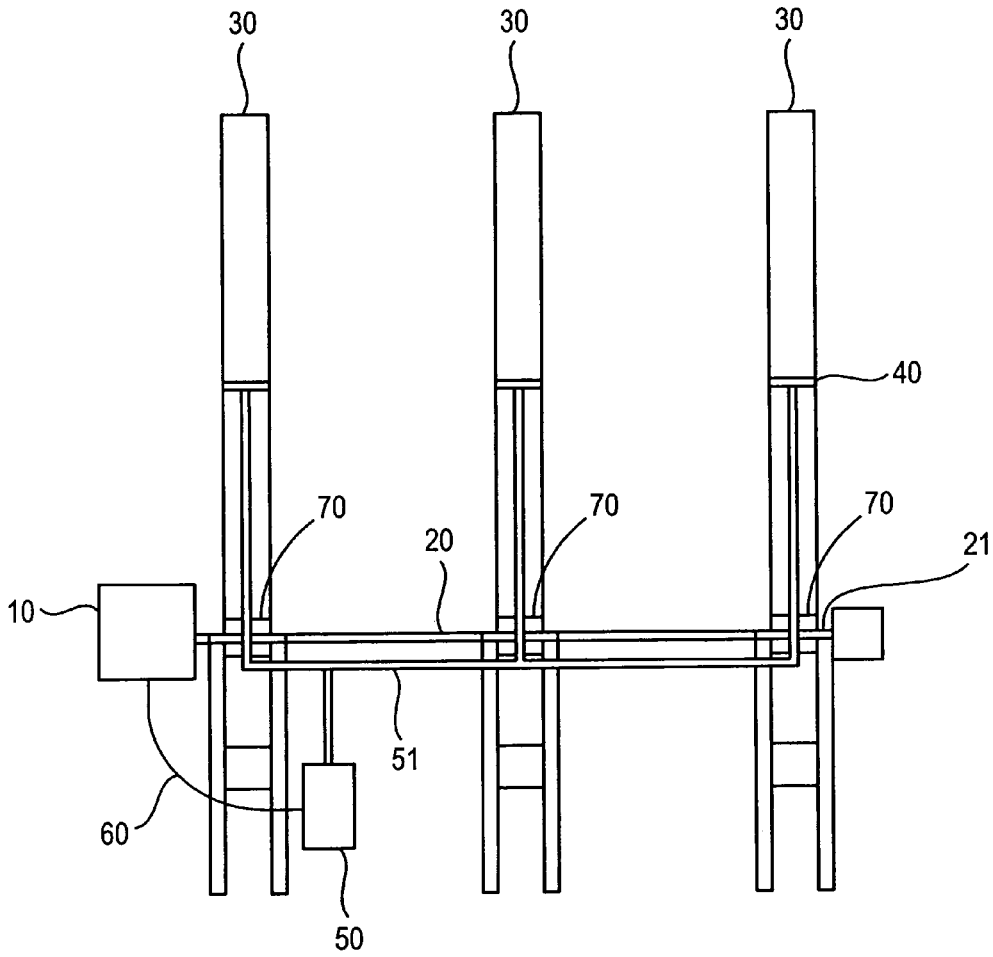
FIG. 1 shows a sketch of the principle of a disconnecting breaker for a three-phase system.

FIG. 1 shows a sketch of the principle of a disconnecting breaker for three poles. An actuator 10 controls a link system, known as a rod system, 20 which connects the poles together and controls the positions of the contacts 30 of the breaker. The positions of the contacts 30 of the breaker are indicated on each pole, for example with a mechanical arrow 70. An earth knife 40 is controlled by its own actuator 50, which is in direct electrical connection with the actuator 10 through a cable 60 connected between the actuators. When the disconnecting breaker is locked, the actuator 10 is first locked both electrically and mechanically with the aid of an electromagnet 12. After this, the rod system 20 of the breaker 30 is locked mechanically. The indication is achieved in one preferred embodiment electrically with a lamp and mechanically with, for example, an arrow. The key-and lock device in one preferred embodiment is a Castel lock with the associated keys. When both the actuator 10 and the rod system 20 are locked, manual operation and locking of the earth knife 40 according to known technology are possible.

Figure 2:
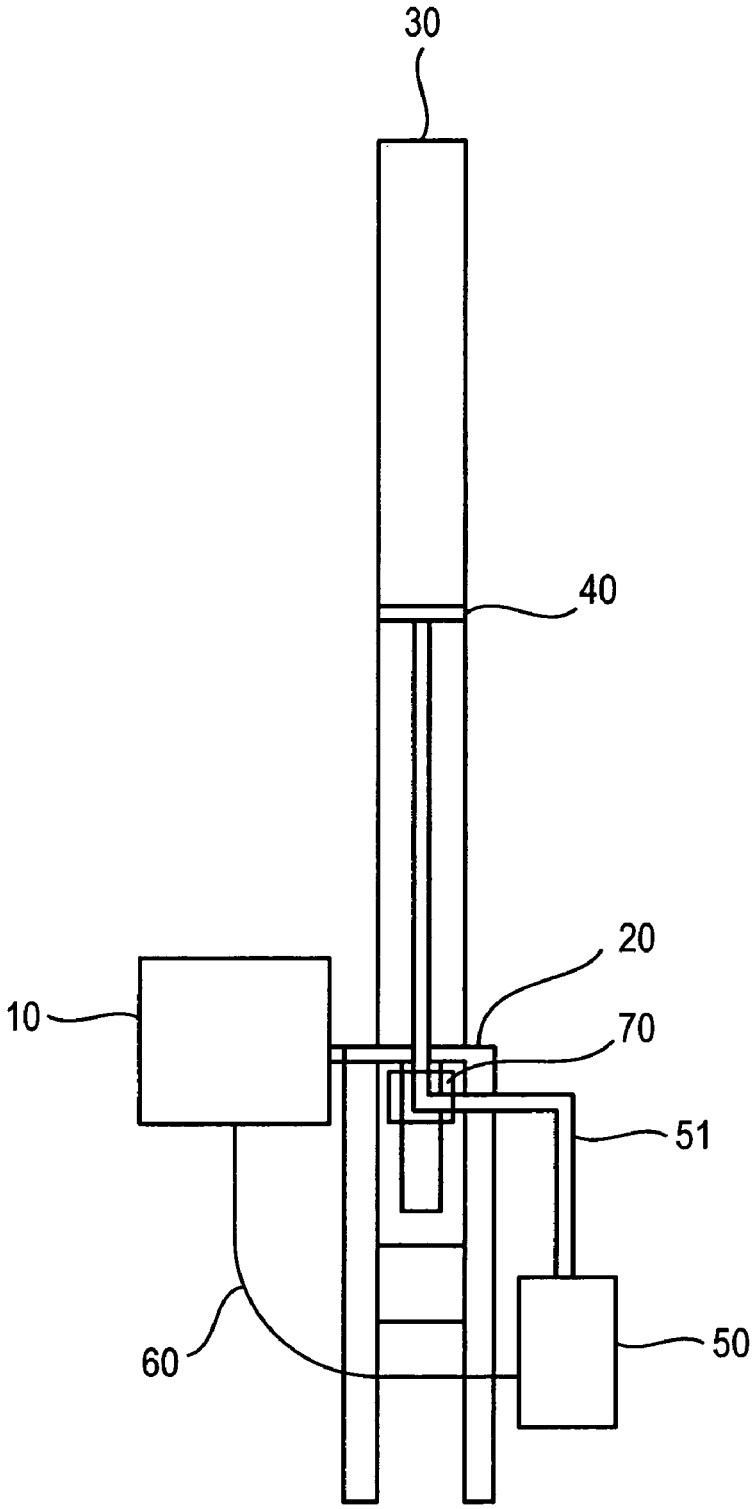
FIG. 2 shows a sketch of the principle of a disconnecting breaker for a single-phase system.

FIG. 2 shows a sketch of the principle of a disconnecting switch for a single pole. An actuator 10 controls a link system, also known as a rod system, 20 which controls the position of the breaker contacts, e.g. the contacts 30. The positions of the breaker contacts are indicated, for example, with a mechanical arrow 70. An earth knife 40 is controlled by its own actuator 50, which is in direct electrical connection with the actuator 10 through a cable 60 connected between the actuators. When the single-pole disconnecting switch is locked, the breaker is locked according to the same principle as the three-pole disconnecting switch.

One embodiment of the present invention provides a device for locking a circuit breaker in an open or closed position. In this embodiment, a set of breaker contacts operated by a linking system is in mechanical communication with an actuator. Operation of the actuator, in turn, moves the set of breaker contacts into either an open or closed position by moving the linking system. The position of each of the set of breaker contacts may be indicated by an indicator, for example, by a mechanical arrow. In addition to operating the linking system to open or close the set of breaker contacts, the actuator may further contain devices for locking the linking system in the open or closed position by both mechanical and electrical means.

Operation of the breaker is controlled by an actuator driving the linking system. An electromagnet is used to position at least one locking shackle so as to mechanically prevent operation of a blocking package, which mechanically prevents operation of the actuator thereby maintaining the set of breaker contacts in the open or closed position. Electrical locking is achieved by disconnecting the operating current to the electromagnet operating the locking shackle after positioning this locking shackle. Therefore, once electrical locking has occurred, the positioned locking shackle may not be retracted by the electromagnet until such current is restored. Electrical locking may be indicated by mechanical and/or electrical indicators present on the actuator, for example, by illumination of a green lamp and/or a mechanical arrow pointing to a green field.

In one embodiment, the far end of the rod attached to the actuator extends outward from the outer breaker pole housing when the breaker contacts are in the open position and thus allows for it to be mechanically blocked by a physical connection, for example, to a blocking plate or other similar device to prevent the rod from moving once the breaker is in the open position. The visible extension of the rod upon placing the breaker contacts in the open position further serves as an indicator that the breaker is in an open position and allows for closing of the earth knife. The position of the blocking plate can be designed to serve as an indicator that blocking by the blocking plate has been achieved.

FIGS. 3A–3C show the actuator 10 for control of the rod system 20 and thus the position of the contacts 30. The actuator 10 includes a blocking package 11 that solidly prevents mechanical movement of the actuator 10 and thus also any operation of the breaker contacts. The blocking package 11 prevents operation of the breaker 30 together with an electromagnet 12 equipped with a mechanical locking shackle 13 or equivalent device. The mechanical locking shackle 13 or equivalent device mechanically prevents any unintended movement of the blocking package. When a first key 18 is turned in the lock 14, the electromagnet 12 releases, and operating current to the blocking package 11 is interrupted. The blocking package 11 is locked by breaking its operating current and by turning off the operating current to the electromagnet 12 equipped with the mechanical locking shackle 13. Under the condition that the breaker is in the OFF position, the shackle 13 is released downwards and mechanically blocks movement of the blocking package from the OFF position to the ON position. Indication that locking of the actuator is achieved may, for example, be realized by the lighting of a green lamp 19 on the external surface of the actuator and by a mechanical arrow 16 pointing towards a green field of a mechanical arrow 16 inside the actuator. An auxiliary contact 17 provides electrical interruption or closing of a signal, which indicates the position of the breaker. When the breaker is OFF and the actuator is locked, a signal is sent via the auxiliary contact 17 and the cable 60 to the actuator 50 of the earth knife. This is one of the conditions that must be satisfied if movement of the earth knife is to be possible. If the breaker is in the ON position when the actuator is locked, the breaker can in one preferred embodiment be automatically switched over to the OFF position. In one preferred embodiment the actuator of the breaker can be locked with the breaker in the ON position. The indicator 70 then indicates that the breaker is in the ON position. Movement of the earth knife is not possible in this condition since this requires a signal via the auxiliary contact 17 and the cable 60 to the actuator of the earth knife.

Figure 4A:
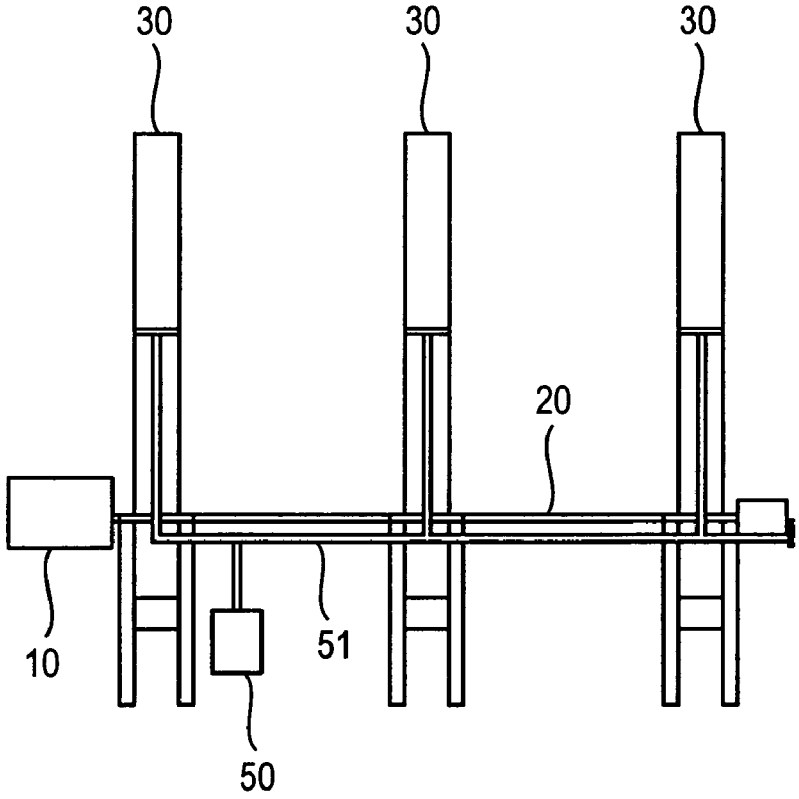
FIGS. 4A–4B show locking of the rod system (a) with a blocking plate and lock (b).
Figure 4B:
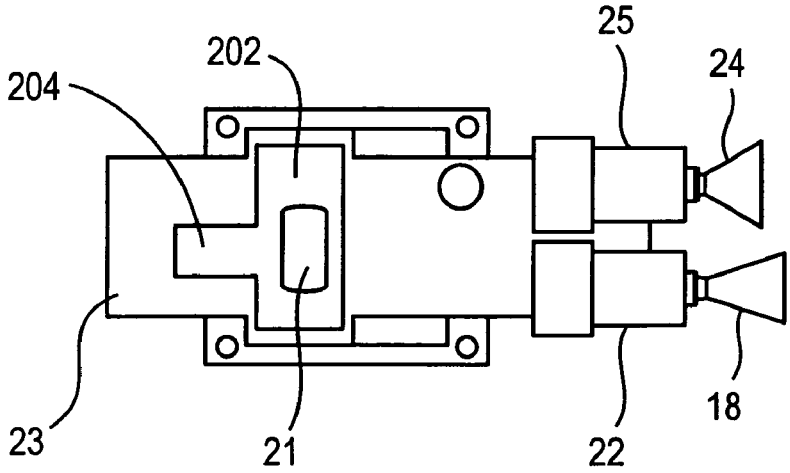

FIGS. 4A–4B show part of a link system, known as a rod system, 20 for operation of the contacts 30 of the breaker. The rod system 20 is equipped with a moving part 21 that is in an inner position when the breaker is ON and an outer, visible position when the breaker is OFF. FIG. 4B shows an exemplary blocking plate 23. As can be seen with respect to FIG. 4B, a hole in the blocking plate 23 includes a first region 202 large enough to permit the moving part 21 to move or rotate freely, and a second region 204 that is smaller than the first region 202. As can be seen from FIG. 4B, the second region 204 is large enough to receive the moving part 21 when the moving part 21 is rotated 90 degrees to align with the second region 204, and will prevent the moving part 21 from rotating when the moving part 21 is in the second region 204, e.g. after the blocking plate 23 has been pushed in a sideways direction. By turning the first key 18 in a second lock 22, manual movement of a blocking plate 23, or other blockage device, is made possible. The blocking plate 23 is pushed in a sideways direction and locked in place with a second key 24 in a third lock 25 such that the moving part 21 and thus the rod system 20 are locked into positions corresponding to open breaker. The locking of the rod system can be indicated with, for example, an arrow.

Figure 5:
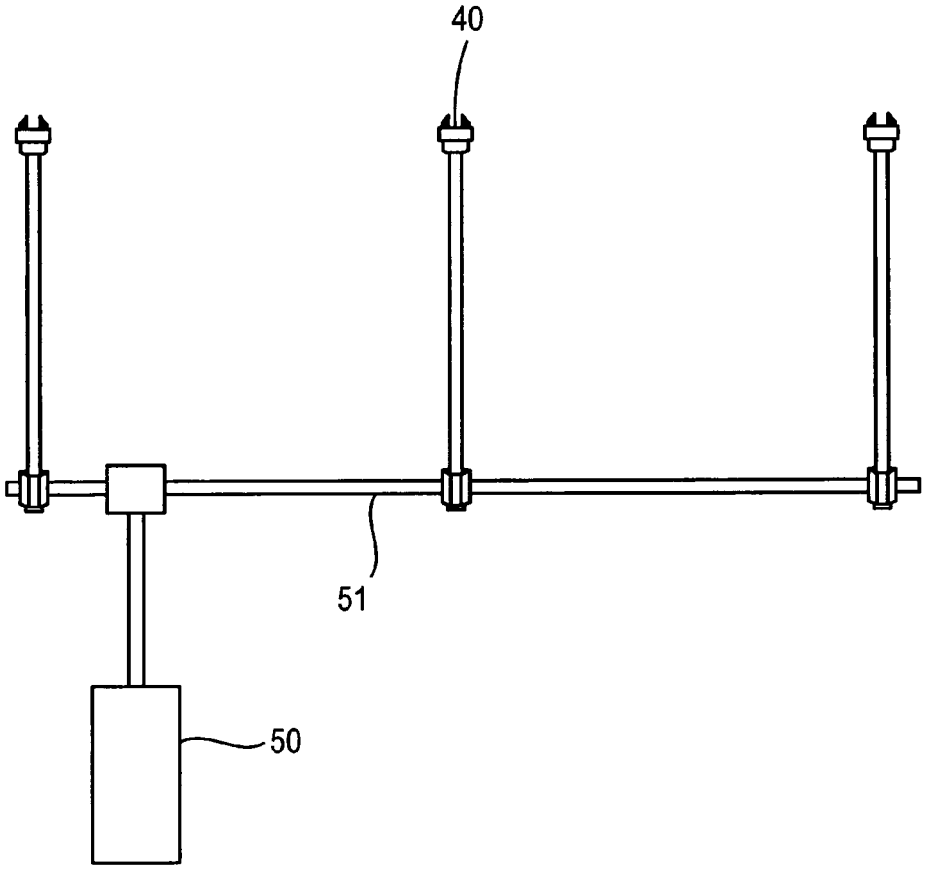
FIG. 5 shows an actuator for an earth knife together with locking of the earth knife with a blocking unit equipped with a lock.

FIG. 5 shows the earth knife 40 with its actuator 50. The position of the earth knife is controlled by a link system 51.

Figure 6A:
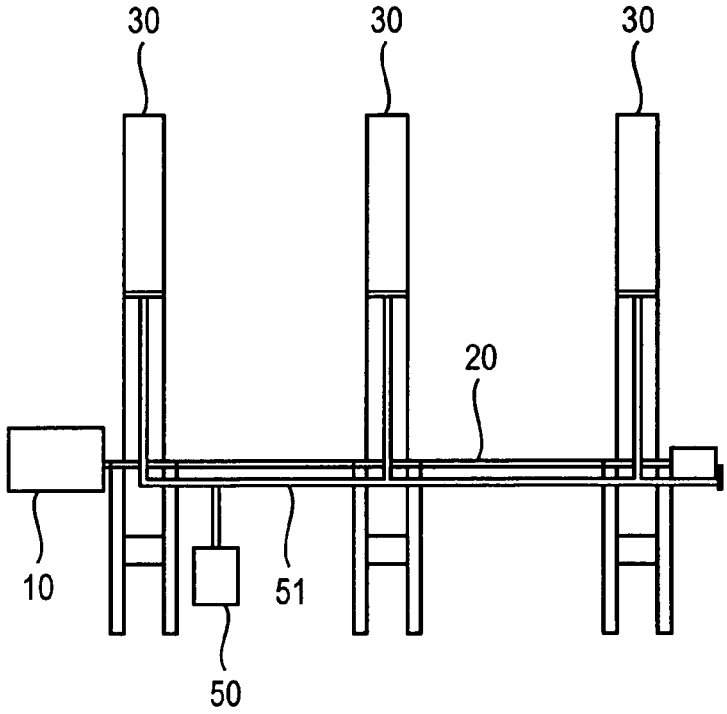
FIGS. 6A–6C show the disconnecting breaker with earth knives (a), blocking device (b) and rotating disk (c) of the locking arrangement of the rod system during remote control.
Figure 6B:
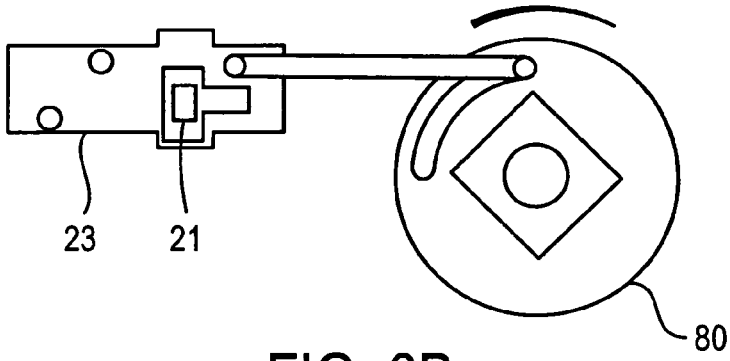
Figure 6C:
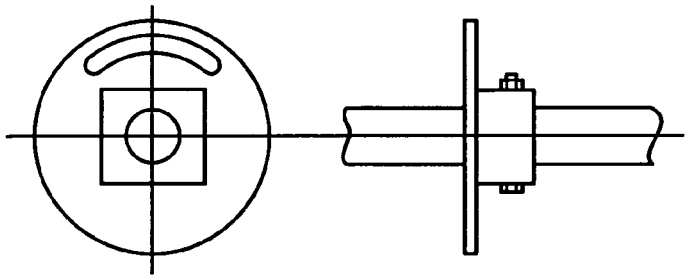

FIGS. 6A–6C show the design of the rod system when remote-controlled locking is used. Movement of the earth knife involves movement of the blocking plate 23 via a rotatable disk 80.

What is claimed is:

1. A disconnecting breaker comprising:

a) at least one set of breaker contacts;

b) an actuator mechanically connected to said at least one set of breaker contacts by a linking system, wherein said actuator controls the position of the breaker contacts between a closed position-and an open position; and c) a mechanical a first lock that blocks the movement of the linking system and maintains said at least one set of breaker contacts in the open position; and d) a second lock that locks the actuator to prevent actuator control of the breaker contacts, wherein the second lock includes an electrical lock that interrupts control power to the actuator and prevents actuator control of said at least one set of breaker contacts.

2. The disconnecting breaker of claim 1 wherein the second lock includes:

an electromagnetically operated locking shackle capable of mechanically locking the second lock to prevent actuator control of said at least one set of breaker contacts.

3. The disconnecting breaker of claim 2 wherein the second lock includes:

an electrical lock that interrupts control power to the electromagnet of the locking shackle.

4. A disconnecting breaker comprising:

a) at least one set of breaker contacts;

b) an actuator mechanically connected to said at least one set of breaker contacts by a linking system, wherein said actuator controls the position of the breaker contacts between a closed position and an open position; and c) an electromagnetically operated blocking package capable of mechanically locking the actuator to prevent actuator control of said at least one set of breaker contacts; and d) an electrical lock that interrupts control power to the actuator and prevents actuator control of said at least one set of breaker contacts.

5. The disconnecting breaker of claim 4 comprising:

an electrical lock that interrupts control power to the blocking package.

6. The disconnecting breaker of claim 5, comprising an electromagnetically operated locking shackle capable of mechanically locking the blocking package.

7. A disconnecting breaker comprising:

a) at least one set of breaker contacts;

b) an actuator mechanically connected to said at least one set of breaker contacts by a linking system, wherein said actuator controls the position of the breaker contacts between a closed position and an open position; and c) an electrical lock that interrupts control power to the actuator and prevents actuator control of said at least one set of breaker contacts; and d) a mechanical lock that blocks the movement of the linking system and maintains said at least one set of breaker contacts in the open position.

8. The disconnecting breaker of claim 7 comprising:

an indicator indicating that the actuator is electrically locked.

9. The disconnecting breaker of claim 7, wherein said disconnecting breaker includes multiple sets of breaker contacts.

10. The disconnecting breaker of claim 7 wherein a distance between the contacts in the open position comprises a conductor spacing for a disconnection function.

11. The disconnecting breaker of claim 7 comprising:

an indicator indicating that the linking system is mechanically locked.

12. The disconnecting breaker of claim 7 comprising:

an electromagnetically operated blocking package capable of mechanically locking the actuator to prevent actuator control of said at least one set of breaker contacts.

13. The disconnecting breaker of claim 12 comprising:

an indicator indicating that the actuator is mechanically locked.

14. The disconnecting breaker of claim 12, wherein the blocking package is operated by remote control.

15. The disconnecting breaker of claim 12 comprising:

an electrical lock that interrupts control power to the blocking package.

16. The disconnecting breaker of claim 15, comprising an electromagnetically operated locking shackle capable of mechanically locking the blocking package.

17. The disconnecting breaker of claim 7, comprising a hand operated first key and lock device to achieve electrical and mechanical locking of the actuator.

18. The disconnecting breaker of claim 17 wherein the operation of the first key and lock device releases an electromagnetic locking shackle that locks a locking package on the actuator.

19. The disconnecting breaker of claim 17, wherein the operation of the hand operated key and lock device causes the breaker to change from said closed position to said open position.

20. The disconnecting breaker of claim 17, comprising a second lock device operated by the first key for mechanical locking of the linking system, wherein locking of a blocking plate and linkage system is achieved by a second key device within a third lock device.

21. The disconnecting breaker of claim 20, comprising an actuator for an earth knife which allows for connection of the earth knife to at least one of the breaker terminals per pole, thereby earthing at least one of the terminals.

22. The disconnecting breaker of claim 21 wherein the fourth lock device is locked with said second key device after said connection.

23. The disconnecting breaker of claim 21, comprising a fourth lock device for locking the earth knife in either an earthed or an unearthed position.

24. A method for locking a disconnecting breaker with at least one set of breaker contacts comprising:

a) activating an actuator mechanically connected to said at least one set of breaker contacts by a linking system, wherein said actuator controls the position of the breaker contacts between a closed position and an open position;

b) engaging a first lock that blocks the movement of the linking system and maintains said at least one set of breaker contacts in the open position; and c) engaging a second lock that locks the actuators, wherein the second lock comprises an electrical lock that interrupts control power to the actuator and prevents actuator control of said at least one set of breaker contacts.

25. Method according to claim 24, wherein the first lock includes a mechanical lock that prevents the movement of the linking system.

26. Method according to claim 24, comprising:

indicating the locking of the linking system using at least one mechanical indicator.

27. The method of claim 24, wherein the first lock and the electrical lock are engaged via remote control.

28. Method according to claim 24, wherein the second lock includes an electrical and a mechanical locking which locks the actuator and prevents movement of the linking system.

29. Method according to claim 28, wherein the electrical and mechanical locking of the actuator is carried out with the breaker in the open position, whereby a distance between the contacts comprises a conductor spacing for a disconnection function.

30. Method according to claim 28, wherein the first lock includes a mechanical lock that prevents the movement of the linking system.

31. Method according to claim 28, comprising:

indicating the electrical and mechanical locking using an electrical indicator and a mechanical indicator.

32. Method according to claim 28, wherein the electrical and mechanical locking of the actuator is achieved by means of a hand-operated first key- and lock device.

33. Method according to claim 32, wherein the operation of the first key- and lock device releases an electromagnetic locking shackle that locks a blocking package on the actuator.

34. Method according to claim 32, wherein the electrical and mechanical locking of the actuator is carried out with the breaker in the closed position, whereby the hand-operated first key- and lock device achieves an automatic change of the breaker from said closed position to said open position.

35. Method according to claim 32, wherein the first key of said first key- and lock device is freed from said key- and lock device following the locking of the actuator and is used in a second lock device for mechanical locking of the linking system with the aid of a blocking plate, which locking is achieved by a second key device with a third lock device.

36. Method according to claim 35, wherein an actuator for an earth knife or equivalent earth device is unlocked from a fourth lock device with said second key device so as to allow connection of the earth knife to the breaker, and is locked with the second key device and the fourth lock device after said connection.

37. Method according to claim 35, wherein the electrical and mechanical locking of the actuator of the breaker is carried out with the breaker in the closed position, whereby the first key device is blocked into the lock device following the locking of the actuator.

38. Method according to claim 28, wherein the electrical and mechanical locking of the actuator of the breaker is achieved by means of a remote control.

39. Method according to claim 38, wherein the remote-controlled electrical and mechanical locking of the actuator of the breaker is carried out with the breaker in the open position, whereby the distance between the contacts comprises a conductor spacing for a disconnecting function.

40. Method according to claim 39, wherein said locking includes mechanical movement of a blocking device for an earth knife, after which movement of the earth knife involves mechanical locking of the linking system.

* * * * *